US006767292B1

(12) United States Patent
Skalla, Sr.

(10) Patent No.: US 6,767,292 B1
(45) Date of Patent: Jul. 27, 2004

(54) GOLF PUTTER WITH A REAR MOUNTED SHAFT

(76) Inventor: Richard John Skalla, Sr., P.O. Box 428, Tonto Basin, AZ (US) 85553

( * ) Notice: Subject to any disclaimer, the term of this patent is extended or adjusted under 35 U.S.C. 154(b) by 0 days.

(21) Appl. No.: 10/319,249

(22) Filed: Dec. 13, 2002

Related U.S. Application Data

(63) Continuation-in-part of application No. 09/843,974, filed on Apr. 26, 2001, now abandoned.

(51) Int. Cl.[7] ..... A63B 69/36; A63B 53/04

(52) U.S. Cl. ..... 473/251; 473/293; 473/340; 473/313

(58) Field of Search ..... 473/324, 325, 473/313, 314, 340, 341, 251, 252, 293, 294, 409, 255, 256, 264, 265; 273/129 R, 129 L; D21/735, 736, 738, 739, 740, 741, 742

(56) References Cited

U.S. PATENT DOCUMENTS

| | | | | | |
|---|---|---|---|---|---|
| D106,293 | S | * | 10/1937 | Hilton | D21/738 |
| 2,472,312 | A | * | 6/1949 | Parrish | 473/330 |
| 2,621,044 | A | * | 12/1952 | Sloan | 473/236 |
| 2,843,384 | A | * | 7/1958 | Schmidt | 473/204 |
| 3,042,405 | A | * | 7/1962 | Karsten | 473/313 |
| 3,163,422 | A | * | 12/1964 | Murray | 273/129 R |
| 3,194,564 | A | * | 7/1965 | Swan | 473/236 |
| 3,220,730 | A | * | 11/1965 | Fine | 473/230 |
| 3,319,962 | A | * | 5/1967 | Summers | 473/251 |
| 3,394,937 | A | * | 7/1968 | Allport | 473/293 |
| 3,430,963 | A | * | 3/1969 | Wozniak et al. | 473/251 |
| 3,486,755 | A | * | 12/1969 | Hodge | 473/251 |
| 3,591,176 | A | * | 7/1971 | Roth | |
| 3,851,877 | A | * | 12/1974 | Giambazi | 473/313 |
| 3,954,265 | A | * | 5/1976 | Taylor | 473/252 |
| 4,010,958 | A | * | 3/1977 | Long | 473/341 |
| 4,253,667 | A | * | 3/1981 | Clark et al. | 473/325 |
| 4,290,606 | A | * | 9/1981 | Maxwell | 473/569 |
| 4,508,342 | A | * | 4/1985 | Drake | 473/204 |
| 4,529,202 | A | * | 7/1985 | Jacobson | 473/256 |
| 4,852,877 | A | * | 8/1989 | Scalf | 473/252 |
| 5,346,219 | A | * | 9/1994 | Pehoski et al. | 473/325 |
| 5,458,332 | A | * | 10/1995 | Fisher | 473/251 |
| 5,476,262 | A | * | 12/1995 | Bandiero | 473/409 |
| 5,494,282 | A | * | 2/1996 | Pranio | 473/313 |
| D367,909 | S | * | 3/1996 | Lee | D21/759 |
| D385,324 | S | * | 10/1997 | Ubaney | D21/759 |
| D389,539 | S | * | 1/1998 | Moore | D21/739 |
| 5,749,791 | A | * | 5/1998 | Passeri, Jr. | 473/251 |
| D399,274 | S | * | 10/1998 | Bradford | D21/736 |
| 5,857,920 | A | * | 1/1999 | Hong | 473/240 |
| D408,878 | S | * | 4/1999 | Patten | D21/743 |
| D410,716 | S | * | 6/1999 | Bendo et al. | D21/736 |
| D412,729 | S | * | 8/1999 | Woodward | D21/743 |
| 5,947,838 | A | * | 9/1999 | Tkacs | 473/314 |
| 5,993,324 | A | * | 11/1999 | Gammil | 473/251 |
| 5,997,409 | A | * | 12/1999 | Mattson | 473/244 |
| 6,019,689 | A | * | 2/2000 | Hogan | 473/409 |
| D421,471 | S | * | 3/2000 | Moldovan | D21/744 |
| D422,041 | S | * | 3/2000 | Bradford | D21/736 |
| D422,328 | S | * | 4/2000 | Lannoch | D21/743 |
| 6,394,910 | B1 | * | 5/2002 | McCarthy | 473/251 |

* cited by examiner

*Primary Examiner*—Sebastiano Passaniti
(74) *Attorney, Agent, or Firm*—John D. Gugliotta; Olen L. York, III

(57) ABSTRACT

A golfing putter comprises a shaft, a putter head and a pair of runner guides. The linearly elongated shaft is inserted at the rear of the putter head and disposed at angle to accommodate golfers seated in a wheel chair. The top of the putter head includes an alignment indicia, thereby providing a means for properly aligning the center of the putter face with the center of the golf ball and on the correct intended putting line. The pair of runner guides are positioned at the bottom of the putter head, intermediate to the putter head and the putting surface, and run parallel to the direction of the shaft and the intended putting line. The rearmost portion of the runner guides includes a rounded surface so as to elevate the putter face, thereby minimizing drag on the putter as it is stroked and encouraging overspin to the struck golf ball.

16 Claims, 5 Drawing Sheets

GOLF PUTTER WITH A REAR MOUNTED SHAFT

RELATED APPLICATIONS

The present invention was first described in U.S. Provisional Ser. No. 60/211,282 filed on Jun. 13, 2000, and is a continuation-in-part of U.S. Ser. No. 09/843,974 filed on Apr. 26, 2001, herein abandoned.

BACKGROUND OF THE INVENTION

1. Field of the Invention

The present invention relates generally to putting devices used in golf, and, more particularly, to a putter a shaft inserted at the rear of a putter head and including a pair of guiding side members.

2. Description of the Related Art

As is well known in the art, a number of different kinds of golf clubs, and especially putters, are known. Relevant to these golf putters, the prior art can generally be grouped into two categories: putters having use-oriented aids and putting stroke training devices.

Putters having use-oriented aids are disclosed in the art as a means to assist the golfer in using a typical putter, or as an improved putter for use during a game of golf. For instance, an attachment to the shaft of a putter that aids in aligning the golf club at a right angle to a line between the ball and the hole. Others attach to the shaft of a putter and deploy to provide a guide for the putter user. The addition of an indicator surface allows for contrast with the putting surface and helps to avert the problem of the golfer's eyes attempting to focus simultaneously on the ball, the club face, and the pointer of the putter guide concurrently and thereby losing sight of the pointer device.

Another problem that occurs from the use of a typical putter is the turning of the putter head while in use by the golfer. This putting error is caused by the imperceptible turning of the shaft of the putter as the head of the putter approaches or comes into contact with the ball. For example, and illustrating potential problems using a right-handed putter, the slight turning of the putter shaft may result in the toe of the putter passing ahead of the heel of the putter, thereby shutting the putter face and causing the line of the putt to start to the left of the target line. Conversely, slight turning of the putter shaft may result in the heel passing the toe, resulting in an opened putter face and causing the line of the putt to start to the right of the target line. Numerous attempts have been offered to correct this problem.

Other methods for eliminating putting errors caused by the turning of the putter shaft during use are known. For instance, a putter device that includes an internal spinning gyroscope device inside the putter head to provide sufficient momentum necessary to prevent any "turning" of the shaft when the putter head approaches or comes in contact with the ball. However, a putter made in accordance with such references is associated with several drawbacks, the most significant of which is that a putter made in such a manner would appear to not meet all of the requirements and rules of the U.S. Golf Association (USGA), the governing body and policy maker for professional and amateur golf in the United States.

Additionally, many putt-training devices are disclosed in the prior art that attempt to assist a golfer in developing proper, consistent habits that generally result from practice conducted with the proper information feedback.

A search of the prior art did not disclose any patents that read directly on the claims of the instant invention; however, the following references were considered related.

The following patents disclose the ornamental design for a golf putting head:

U.S. Pat. No. D 422,328 issued in the name of Lannoch;

U.S. Pat. No. D 422,041 issued in the name of Bradford;

U.S. Pat. No. D 421,471 issued in the name of Moldovan;

U.S. Pat. No. D 412,729 issued in the name of Woodward;

U.S. Pat. No. D 410,716 issued in the name of Bendo et al.;

U.S. Pat. No. D 408,878 issued in the name of Patten;

U.S. Pat. No. D 399,274 issued in the name of Bradford;

U.S. Pat. No. D 389,539 issued in the name of Moore;

U.S. Pat. No. D 385,324 issued in the name of Ubaney; and

U.S. Pat. No. D 367,909 issued in the name of Lee.

The following patents disclose the design and function for a golf putting training head:

U.S. Pat. No. 5,857,920, issued in the name of Hong, discloses a golf club for putting and driving a golf ball, wherein the club has a reflective surface to properly direct the alignment of a golfer's eyes to an image of the ball, and also including a leveling device in the head of the club so as to indicate when the putter head is properly aligned in a horizontal orientation;

U.S. Pat. No. 5,458,332, issued in the name of Fisher, discloses a golf putter head with a cushion face, wherein the face of the putter receives a polyurethane insert or pad at a ball impact position;

U.S. Pat. No. 5,476,262, issued in the name of Bandiero, discloses a putter trainer having a substantially "U"-shaped head with a space provided between two sidewalls so as to receive a golf ball, thereby forcing a golfer to extend the putting follow through approximately five to eight inches in a straight line and providing a simulation of the proper follow through necessary to successfully putt;

U.S. Pat. No. 4,253,667, issued in the name of Clark et al, discloses a golf ball putter that distributes the mass of the putter head along the line of the putt because the putter shaft is connected to the putter head at a point centrally of the length and width of the head; and U.S. Pat. No. 2,472,312, issued in the name of Parrish, discloses a putter directed to impart top spin to a struck golf ball, thereby eliminating the possibility of the golf ball drifting from the intended putting line, wherein the putter has a horizontally elongated head with a pair of legs vertically depending from the ends of the head down to the putting surface.

Consequently, a need has been felt for providing an apparatus and method of improving putting skills and assisting a golfer in practicing a number of aspects of putting. In particular, a need has been felt for providing a golf putter that accommodates disabled golfers, including golfers that require the use of wheel chairs. Golfers that use wheel chairs often have difficulty properly aligning themselves over the ball, and then making the traditional back-and-through pendulum-type putting stroke used by a majority of golfers. A putter having a rear mounted shaft disposed at an appropriate angle allows one in a wheel chair to position themselves behind the ball, and properly align the putter face and the ball with the golf hole along a more accurate line. Furthermore, the rear mounted shaft allows one to comfortably pull the club back and follow through, thereby averting the potential twisting and turning on the lower back that a standard pendulum putting stroke requires, which might be especially stressful on a person using a wheel chair.

SUMMARY OF THE INVENTION

It is therefore an object of the present invention to provide an improved golf putting apparatus.

It is a feature of the present invention to provide an improved golf putting apparatus including offering an alternative putting stroke, wherein the golfer stands facing the intended line of the putt and placing a back-and-through stroke on the putter.

It is a further feature of the present invention to provide an improved golf putting apparatus offering an alternative putting stroke to golfer's that require the use of a wheel chair, thereby minimizing the twisting and turning of the back.

Briefly described according to one embodiment of the present invention, a golfing putter is provided comprising a shaft, a putter head and a pair of runner guides. The shaft is a linearly elongated shaft inserted at the rear of the puffer head and disposed at angle to accommodate golfers seated in a wheel chair. The top of the putter head includes an alignment indicia, thereby providing a means for properly aligning the center of the puffer face with the center of the golf ball and on the correct intended putting line. The pair of runner guides are positioned at the bottom of the putter head, intermediate to the putter head and the putting surface, and run parallel to the direction of the shaft and the intended putting line. The rearmost portion of the runner guides includes a rounded surface so as to elevate the putter face, thereby minimizing drag on the putter as it is stroked and impart overspin to the struck golf ball. To use the golfing putter, a golfer is positioned so that the golfer's dominant arm (or putting arm) is substantially in line with the intended putting line. The user's arm will grasp the shaft and align the putter face with the intended putting line. The user will then draw the shaft away from the golf ball and then push the shaft into and through the position of the golf ball and toward the golf hole. The putting motion is similar to the striking motions used in games like shuffleboard, billiards, slow-pitch softball or pitching horseshoes.

An advantage of the present invention includes reduction and/or elimination of wear and tear inflicted on putting surfaces caused by the need to realign the golfer when using a wheel chair.

Another advantage of the present invention is that it is specifically adapted for personal use because of the light weight components and the use of inexpensive materials.

Another advantage of the present invention is the reduction of lower back strain for a golfer using a wheel chair, eliminating the necessary reciprocating twists and turns required to perform a pendulum-type putting motion.

Yet another advantage of the present invention is the adaptability of the apparatus for use by persons having a variety of disabilities, including arm or leg amputation, blindness, paraplegia, or musculoskeletal disorders, among others.

Yet another advantage of the present invention is conformity of the present invention to the equipment guidelines established and enforced by the United States Golf Association (USGA), especially within the division that oversees the development and implementation of equipment for disabled golfers.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
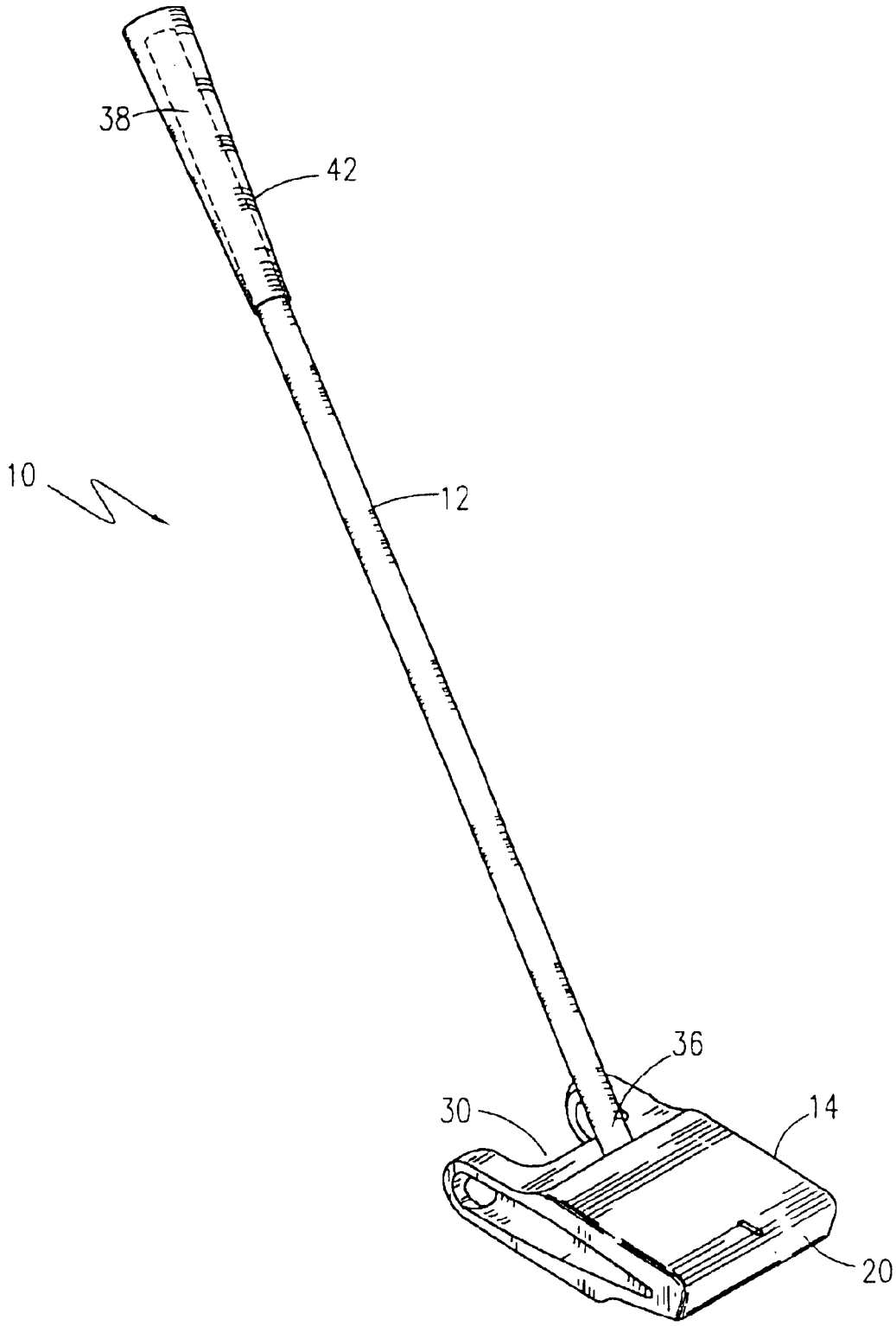
FIG. 1 is a perspective view of a golf putter according to the preferred embodiment of the present invention.

The best mode for carrying out the invention is presented in terms of its preferred embodiment, herein depicted within the FIGS. 1–10.

1. Detailed Description of the Figures

Referring now to FIG. 1 through FIG. 7, a golf putter apparatus 10 is shown in accordance to a preferred embodiment of the present invention. The golf putter apparatus 10 comprises a linearly elongated shaft 12 affixed at its lower end 36 to a rear surface 22 of a configured putter head 14. The putter head 14 comprises a top surface 16, a bottom surface 18, a face 20, a rear surface 22, a first lateral surface 24 and a second lateral surface 26. The top surface 16 is opposite to the bottom surface 18. The face 18 is opposite to the rear surface 22. The face 18 is intermediate to and depending from the top surface 16 and the bottom surface 18, and form an anterior perimeter 28. The rear surface 22 is intermediate to and depending from the top surface 16 and the bottom surface 18, forming a posterior perimeter 30. The first lateral surface 24 is opposite to the second lateral surface 26. The first lateral surface 24 is intermediate to and depending from the top surface 16 and the bottom surface 18, and forms a first lateral perimeter 32. The second lateral surface 24 is intermediate to and depending from the top surface 16 and the bottom surface 18, and forms a second lateral perimeter 34. The top surface 16, the bottom surface 18, the face 20, the rear surface 22, the first lateral surface 24 and the second lateral surface 26 are arranged in a manner substantially forming a general hexahedron shaped putter head 14.

Figure 2:
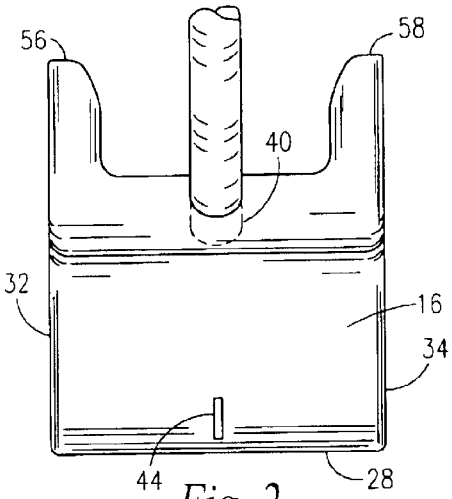
FIG. 2 is a front elevational view of the golf putter, specifically illustrating the alignment indicia.
Figure 5:
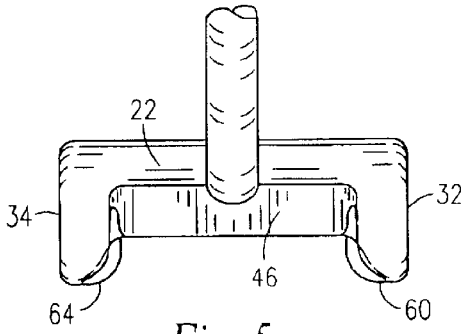
FIG. 5 is a rear view of the golf putter, specifically illustrating the rear insertion of the linearly elongated shaft into the putter head and the rear portions of the pair of guide rails.
Figure 6:
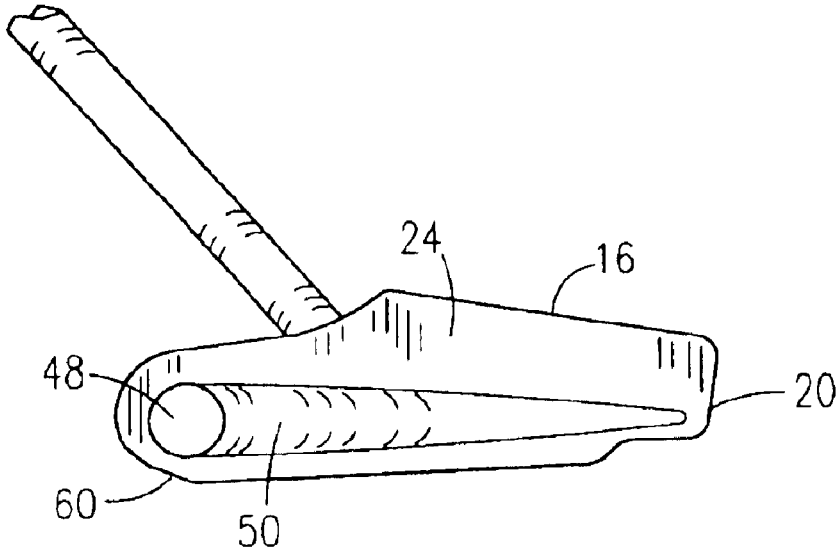
FIG. 6 is a side view of the golf putter, illustrating the rounded rear portions of the pair of guide rails.
Figure 7:
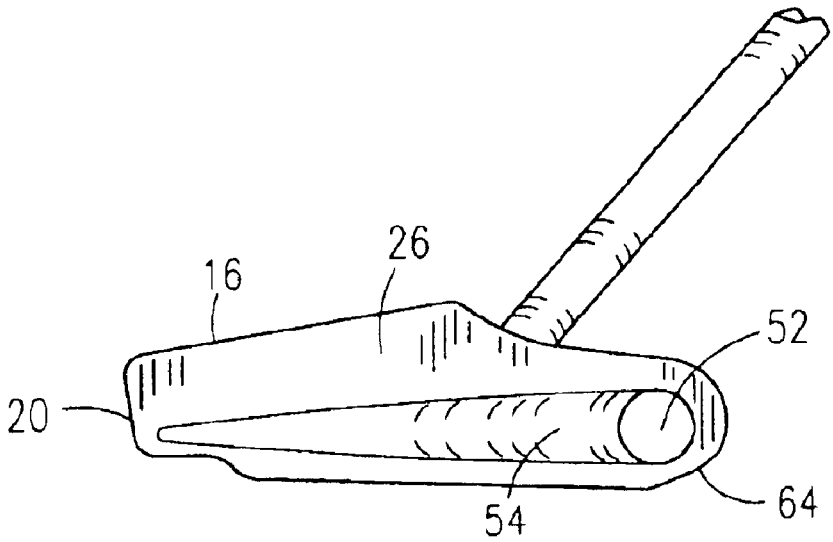
FIG. 7 is a side view of the golf putter, opposite to the side view depicted in FIG. 6.
Figure 8:
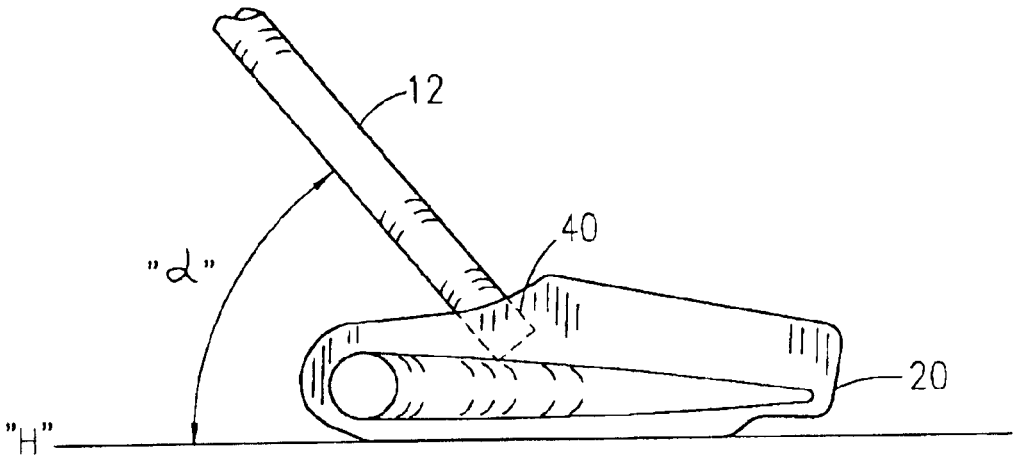
FIG. 8 is a side view of the golf putter, illustrating the angular disposition "$\alpha$" of the shaft as inserted into the rear surface in relation to a horizontal plane "H"

Referring now to FIG. 1, FIG. 2 and FIG. 5, the linearly elongated shaft 12 terminates at two ends, a lower end 36 and an upper end 38. The lower end 36 inserts into a receiving orifice 40 in the rear surface 22. An adhesive, such as industrial strength glue, resin or epoxy, coats the lower end 36 and the internal surface of the receiving orifice 40 to securely and mechanically impinge the shaft 12 therein. The upper end 38 receives a grip 42 configured to specifically accommodate a particular user's hand. An adhesive coats the internal surface of the grip 42 and the outer circumference of the upper end 38. Optionally, golfing tape may be used to raise the outer circumference of the upper end 38, thereby creating a thicker putter grip 42 for the user. The shaft 12 may be of steel, titanium, graphite, hickory or other metal or plastic composite or wood based materials. The shaft 12 is inserted into the orifice 40 at angle "α" between twenty degrees (20°) and sixty degrees (60°) from a horizontal plane "H" so as to accommodate a golfer that is using the golf putter apparatus 10 from a wheel chair. The angle is lowered in the direction to the putting surface to accommodate the lowered angle that the user will be aligned with.

Figure 10:
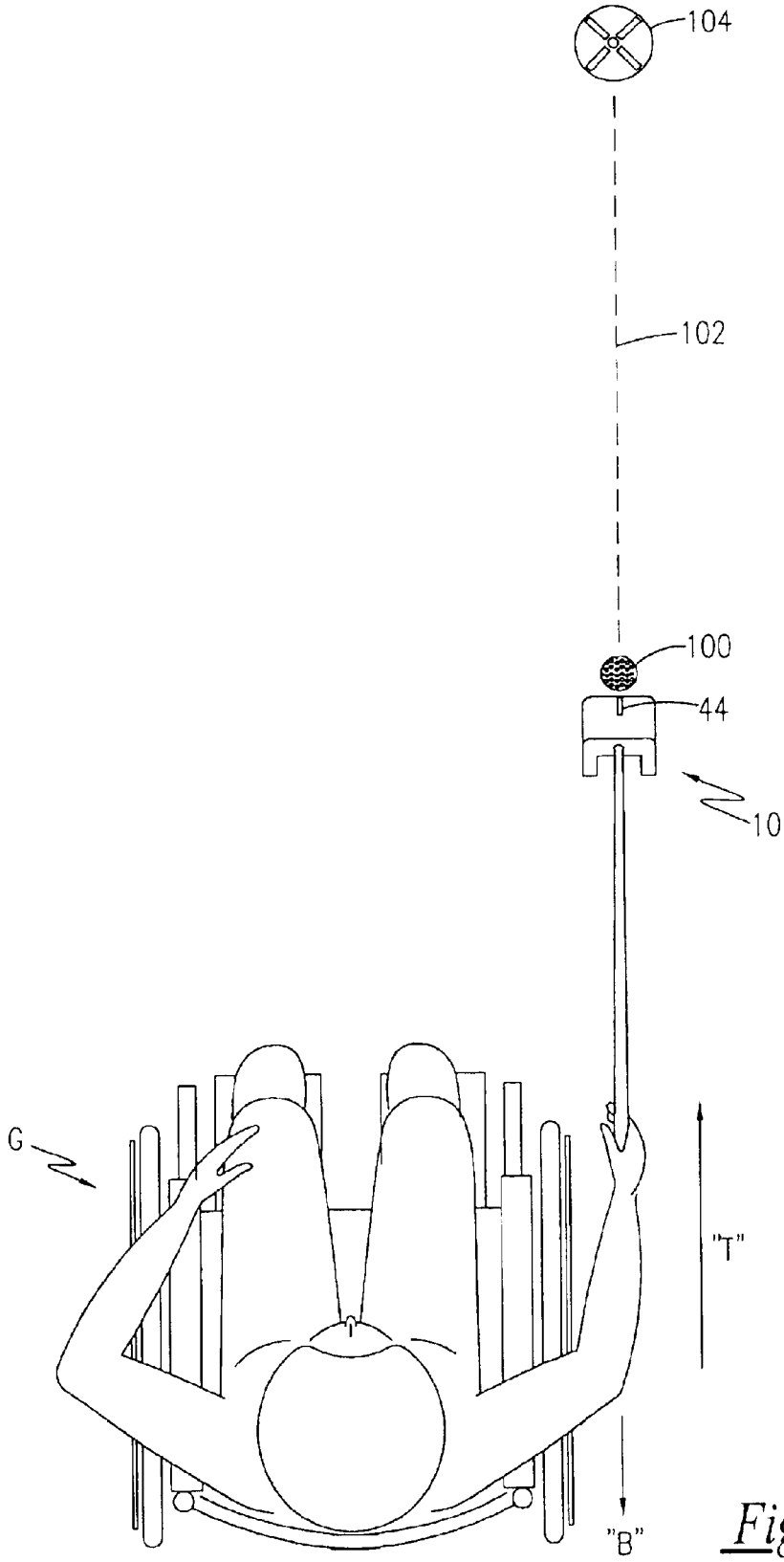
FIG. 10 is a top view of the golf putter in use on a putting surface, wherein a wheel chair is positioned to the left-rear of a golf ball, and the putter is aligned to the alignment indicia along an intended putting line and directed at a golf hole.

The top surface 16 is a member that is integral with the face 20 along an anterior portion of the top surface 16 and is integral with the rear surface 22 along a posterior portion of the top surface 16. The top surface 16 further includes an alignment indicia 44. The alignment indicia 44 is positioned along the anterior portion of the top surface 16, adjacent to a margin where the top surface 16 abuts with the face 20. The alignment indicia 44 is a hash, an arrow, a trademark logo, or other distinctive mark for identifying the horizontal center of the face 20, otherwise known as the "sweet spot" of the putter face 20. Further, the alignment indicia 44 provides a visual alignment aid for aligning the face 20 to the intended putting line of the golf hole (as seen in FIG. 10).

The top surface 16 is envisioned as having a variety of shapes and forms, including planar and curvilinear forms. The top surface 16 may be parallel to or substantially parallel to the putting surface. An alternative embodiment may dispose the top surface 16 at an angle that declines from the posterior perimeter 30 to the anterior perimeter 28. In another alternative embodiment, the top surface 16 may be disposed at an angle that inclines from the posterior perimeter 30 to the anterior perimeter 28. In yet another alternative embodiment, the top surface 16 may have a inwardly curved or outwardly curved surface. In yet another alternative embodiment, the top surface 16 may have a plurality of curves.

Figure 3:
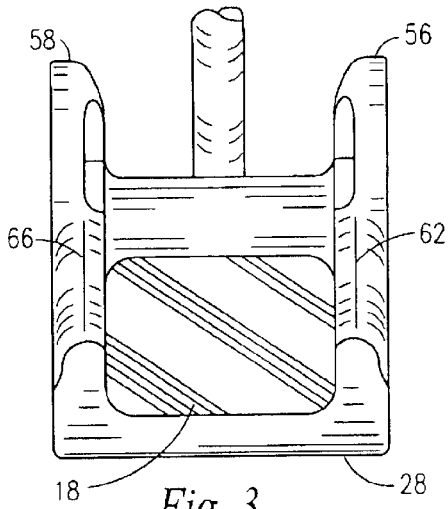
FIG. 3 is a lower elevational view of the golf putter, specifically illustrating the pair of runner guides affixed to the putter head.
Figure 4:
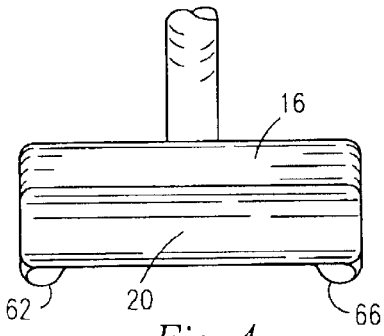
FIG. 4 is a front view of the golf putter, specifically illustrating the spatial relationship between the putter face and the pair of runner guides.

Referring now to FIG. 3, the bottom surface 18 may be parallel or substantially parallel to the putting surface. A depression 46 is formed on the bottom surface 18 and is provided to reduce the mass of the putter head 14, thereby providing reasonable proportional size and weight to the golf putter apparatus 10. Furthermore, the depression 46 allows obstacles, such as longer grass, topographical indentations, or other natural impediments, to pass through without obstructing the stroke path of the golf putter apparatus 10. A pair of guide assemblies 56 and 58 (explained in greater detail below) are integrally affixed to the bottom surface 18 along the margins where the bottom surface 18 abuts against the first lateral surface 24 and the second lateral surface 26, respectively.

Figure 9:
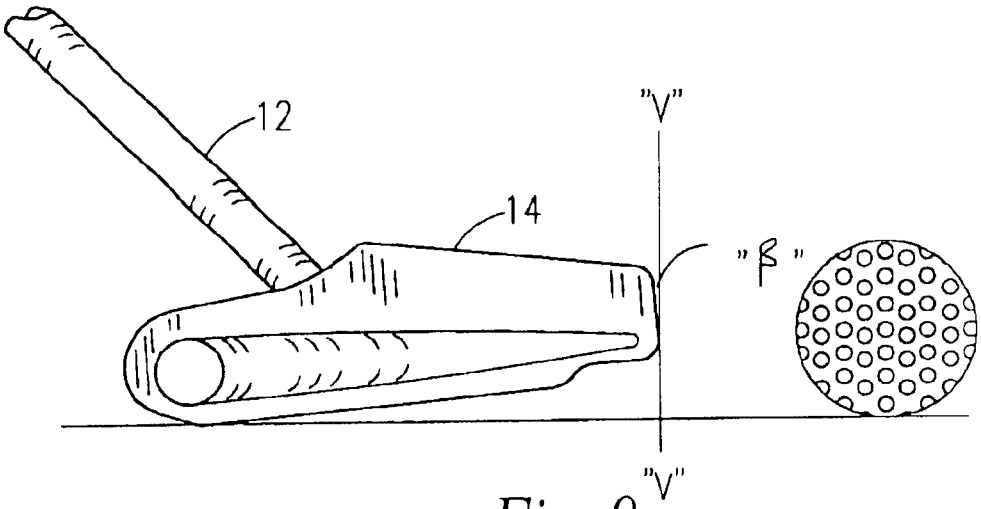
FIG. 9 is a side view of the golf putter, illustrating the angular disposition "$\beta$" if the putter face in relation to a vertical axis "V—V"

Referring now to FIG. 1 and FIG. 9, the face 20 is a laterally elongated surface provided for striking a golf ball, preferably while on or in close proximity to a putting surface. The face 20 is disposed at an angle "β" between zero degrees (0°) and five degrees (5°) relative to a vertical axis "V—V". The angle of the face provides a necessary quantity of momentum when striking the golf ball. The face 20 may be constructed from the same material as the putter head 14, such as steel, titanium, graphite, aluminum or other durable material. Furthermore, the face 20 may be configured to have an insert of a variety of materials, such as soft metals, acrylics, rubber or other similar substances. The face 20 may be manufactured to have a scored or milled texture, thereby providing the user with better control or feel for the direction and striking angle of the putter head 14.

Referring now to FIG. 2 and FIG. 5, the rear surface 22 is a surface that is intermediate to the top surface 16 and the bottom surface 18. The rear surface 22 includes a receiving orifice 40 formed as a substantially circular opening with a cylindrical interior. The receiving orifice 40 receives the lower end 36 of the shaft 12, in conjunction with an appropriate application of adhesive. The orifice 40 and adhesive act to provide a secure and impinged relationship between the lower end 36 and the rear surface 22, thereby maintaining the shaft 12 at a desired angle to accommodate the user. The rear surface 22 is envisioned to have a variety of shapes and forms in relation to the top and bottom surfaces 16 and 18, respectively. The rear surface 22 may be perpendicular to the top and bottom surfaces 16 and 18, forming a box-shaped rear. In another embodiment, the rear surface 22 may be angled to accommodate a longer top or bottom surface 16 or 18, respectively.

Referring now to FIG. 2, FIG. 5, FIG. 6 and FIG. 7, the first lateral surface 24 comprises a first aperture 48 formed in a rear portion of the first lateral surface 24. The first aperture 48 is integral with a linearly elongated first recess 50. The first recess 50 substantially transverses the horizontal length of the first lateral surface 24. The first aperture 48 and the first recess 50 are formed and provided to further reduce the mass of the putter head 14, thereby providing reasonable proportions to the golf putter apparatus 10. The first aperture 48 may have a variety of geometric shapes, but for simplicity of this disclosure, only a circular first aperture 48 is provided in the figures. Likewise, the second lateral surface 26 comprises a second aperture 52 formed in a rear portion of the second lateral surface 26. The second aperture 52 is integral with a linearly elongated second recess 54. The second recess 54 substantially transverses the horizontal length of the second lateral surface 24. The second aperture 52 and the second recess 54 are formed and provided to further reduce the mass of the putter head 14, thereby providing reasonable proportions to the golf putter apparatus 10. The second aperture 52 may have a variety of geometric shapes, but for simplicity of this disclosure, only a circular second aperture 52 is provided in the figures.

Referring now to FIG. 2 through FIG. 7, the pair of guide assembly 56 and 58 comprise a first guide assembly 56 and a second guide assembly 58. The first guide assembly 56 is integrally affixed to the bottom surface 18 along the margin where the bottom surface 18 abuts with the first lateral surface 24. The first guide assembly 56 runs parallel to the first lateral surface 24. The first guide assembly 56 further comprises a rounded surface 60 at a rear portion of the first guide rail 56. The rounded surface 60 provides a surface for pivoting and elevating the anterior perimeter 28. The rounded surface 60 is integral with a linearly elongated first rail 62 that forms a contacting surface to the putting surface. Although when elevated, only the rounded surface 60 is contacting the putting surface, the linearly elongated first rail 62 is provided so that the first rail 62 may contact the putting surface along a substantial surface area of the rail 62 and provide directional guidance while putting. The rounded surface 60 forms the outer perimeter of the first aperture 48.

Likewise, the second guide assembly 58 is integrally affixed to the bottom surface 18 along the margin where the bottom surface 18 abuts with the second lateral surface 26. The second guide assembly 58 runs parallel to the second lateral surface 26. The second guide assembly 58 further comprises a rounded surface 64 at a rear portion of the second guide rail 58. The rounded surface 64 provides a surface for pivoting and elevating the anterior perimeter 28. The rounded surface 64 is integral with a linearly elongated second rail 66 that forms a contacting surface to the putting surface. Although when elevated, only the rounded surface 64 is contacting the putting surface, the linearly elongated second rail 66 is provided so that the second rail 66 may contact the putting surface along a substantial surface area of the rail 66 and provided directional guidance while putting. The rounded surface 64 forms the outer perimeter of the second aperture 52.

2. Operation of the Preferred Embodiment

In operation, and in accordance with a preferred embodiment of the present invention, as best illustrated in FIG. 10, a golfer G will position him or herself behind the ball and to the left or right of the line of the intended putting line 102 of the ball, depending upon which hand and arm are used for striking the golf ball 100. The user will choose an intended putting line 102 to hit the golf ball along and into the golf hole 104. The user will align the putter face 18 with the golf ball 100 by using the alignment indicia 44. The golfer G will then draw the golf putter apparatus 10 back along directional arrow "B" and then following through along directional arrow "T", thereby striking the ball and propelling the golf ball 100 along the intended putting line 102 and toward the golf hole 104.

The use of the golf putter apparatus 10 provides a user, especially a user golfing from a wheelchair, the intended benefit of reducing muscle and tissue strain on the lower associated with pendulum-style putting methods. Furthermore, the use of the golf putter apparatus 10, in which the user aligns themselves in a position to which the head of the user is facing the direction of the intended putting line 102, provides an added benefit to the golf course by eliminating the need for repeated movement of the wheelchair to properly align the golfer "G" along the line 102. By reducing such movements, the putting surfaces are maintained and not damaged or destroyed by the wheelchairs.

The foregoing description is included to Illustrate the operation of the preferred embodiment and is not meant to limit the scope of the invention. The scope of the invention is to be limited only by the following claims.

What is claimed is:

1. A golf putter apparatus comprising:

a putter head having;

a top surface;

a bottom surface, said bottom surface opposite to said top surface;

a face, said face intermediate to and depending from said top surface and said bottom surface, and forming an anterior perimeter, said face for striking a golf ball;

a rear surface, said rear surface opposite to said face, said rear surface intermediate to and depending from said top surface and said bottom surface, and forming said posterior perimeter;

a first lateral surface, said first lateral surface intermediate to and depending from said top surface and said bottom surface, and intermediate to and depending from said face and said rear surface, and forming a first lateral perimeter; and a second lateral surface, said second lateral surface opposite to said first lateral surface, said second lateral surface intermediate to and depending from said top surface and said bottom surface, and intermediate to and depending from said face and said rear surface, and forming a second lateral perimeter;

a linearly elongated shaft inserted into said posterior perimeter of said putter head, said linearly elongated shaft inserted at an angle of between twenty degrees (20°) and sixty degrees (60°) so as to accommodate a golfer using a wheel chair.

2. The golf putter apparatus of claim 1, wherein said top surface further comprises an alignment indicia, said alignment indicia positioned along an anterior portion of said top surface and adjacent to an edge where said top surface abuts said face, said alignment indicia for properly aligning said face to a golf hole.

3. The golf putter apparatus of claim 1, wherein said bottom surface further comprises an integrally affixed pair of guide assemblies, said pair of guide assemblies comprising a first guide assembly and a second guide assembly.

4. The golf putter apparatus of claim 3, wherein said first guide assembly is integrally affixed to said bottom surface along a margin where said bottom surface abuts with said first lateral surface, said first guide assembly lying parallel to said first lateral surface.

5. The golf putter apparatus of claim 4, wherein said first guide assembly further comprises:

a rounded surface adjacent to said posterior perimeter, said rounded surface providing a pivotal surface for elevating said anterior perimeter for stroking a golf ball; and a linearly elongated first guide rail, said first guide rail integral with said rounded surface, said first guide rail to provide directional guidance while putting.

6. The golf putter apparatus of claim 5, wherein said rounded surface further provides a slidable surface for striking a golf ball in a draw-back and following-through motion.

7. The golf putter apparatus of claim 3, wherein said second guide assembly is integrally affixed along a margin where said bottom surface abuts with said second lateral surface, said second guide assembly lying parallel to said second lateral surface.

8. The golf putter apparatus of claim 7, wherein said second guide rail further comprises:

a rounded surface adjacent to said posterior perimeter, said rounded surface providing a pivotal surface for elevating said anterior perimeter for stroking a golf ball; and a linearly elongated second guide rail, said second guide rail integral with said rounded surface, said second guide rail to provide directional guidance while putting.

9. The golf putter apparatus of claim 8, wherein said rounded surface further provides a slidable surface for striking a golf ball in a draw-back and following-through motion.

10. The golf putter apparatus of claim 3, wherein said bottom surface further comprises a depression formed so as to reduce the mass of said golf putter apparatus.

11. The golf putter apparatus of claim 1, wherein said face is a laterally elongated surface for striking a golf ball, said face is disposed at an angle of between zero degrees (0°) and five degrees (5°) relative to a vertical axis when said face strikes a golf ball.

12. The golf putter apparatus of claim 1, wherein said rear surface comprises a receiving orifice, said orifice receiving said shaft and an adhesive, said orifice and said adhesive securely impinging said shaft.

13. The golf putter apparatus of claim 1, wherein said first lateral surface comprises a first aperture, said first aperture formed in a rear portion of said first lateral surface, said first aperture integral with a linearly elongated first recess that horizontally spans said first lateral surface.

14. The golf putter apparatus of claim 13, wherein said first aperture and said first recess are formed so as to reduce the mass of said golf putter apparatus.

15. The golf putter apparatus of claim 1, wherein said second lateral surface comprises a second aperture, said second aperture formed in a rear portion of said second lateral surface, said second aperture integral with a linearly elongated second recess that horizontally spans said second lateral surface.

16. The golf putter apparatus of claim 15, wherein said second aperture and said second recess are formed so as to reduce the mass of said golf putter apparatus.

* * * * *